US010155128B1

(12) United States Patent
Lefevre

(10) Patent No.: US 10,155,128 B1
(45) Date of Patent: Dec. 18, 2018

(54) SHED AND MODULAR PLAYSET ACCESSORY SYSTEM

(71) Applicant: Maria Sophia Lefevre, Springfield, VA (US)

(72) Inventor: Maria Sophia Lefevre, Springfield, VA (US)

( * ) Notice: Subject to any disclaimer, the term of this patent is extended or adjusted under 35 U.S.C. 154(b) by 0 days.

(21) Appl. No.: 15/968,542

(22) Filed: May 1, 2018

(51) Int. Cl.

| | |
|---|---|
| ***A63B 17/04*** | (2006.01) |
| ***E04H 1/12*** | (2006.01) |
| ***E04B 1/343*** | (2006.01) |
| ***E04H 3/10*** | (2006.01) |
| ***A63B 9/00*** | (2006.01) |

(52) U.S. Cl.
CPC ..... *A63B 17/04* (2013.01); *A63B 9/00* (2013.01); *E04B 1/34315* (2013.01); *E04H 1/1205* (2013.01); *E04H 3/10* (2013.01); *A63B 2009/006* (2013.01); *A63B 2208/12* (2013.01); *A63B 2210/50* (2013.01)

(58) Field of Classification Search
CPC ..... A63B 17/04; A63B 9/00; E04H 1/1205; E04H 3/10; E04B 1/34315
USPC ..... 52/36.4
See application file for complete search history.

(56) References Cited

U.S. PATENT DOCUMENTS

| | | | | |
|---|---|---|---|---|
| 1,889,760 | A | 12/1932 | Peters | |
| 2,465,187 | A | 3/1949 | Barrabee | |
| 3,516,659 | A | 6/1970 | Kleid | |
| 3,869,836 | A * | 3/1975 | Allen | E04B 1/34336 52/146 |
| 4,257,492 | A | 3/1981 | Rasada, Jr. et al. | |
| 4,343,117 | A * | 8/1982 | Shemitz | A47B 47/0075 211/118 |
| 4,343,464 | A | 8/1982 | Dose | |
| 4,369,965 | A | 1/1983 | Ahrens | |
| 4,876,830 | A * | 10/1989 | Wate | E04H 1/1205 52/29 |
| 5,151,069 | A * | 9/1992 | Skalka | A63B 9/00 482/35 |
| 5,697,851 | A | 12/1997 | Delgado | |
| 5,733,165 | A | 3/1998 | Kelley | |
| 5,819,479 | A * | 10/1998 | Rodriguez-Ferre | A63H 33/008 52/79.4 |
| 5,820,471 | A * | 10/1998 | Briggs | A63B 9/00 472/128 |
| 5,941,041 | A | 8/1999 | Robinson et al. | |
| 6,357,550 | B1 * | 3/2002 | Willson | E04H 1/1205 182/131 |

(Continued)

FOREIGN PATENT DOCUMENTS

| | | |
|---|---|---|
| EP | 0534058 A1 | 6/1992 |
| FR | 2579720 | 10/1986 |

*Primary Examiner* — Charles A Fox
*Assistant Examiner* — Joseph J. Sadlon
(74) *Attorney, Agent, or Firm* — PK Patent Law

(57) ABSTRACT

A shed and modular playset accessory system and a kit are provided. The storage shed can include a roof and a removeable platform is capable of being operatively arranged with the storage shed above the roof. The system can include a plurality of playset accessories that are capable of being releasably secured to the removeable platform. The system provides an outdoor structure for storage while also conserving yard space for modular playset accessories that can be periodically interchanged, upgraded, and removed after being outgrown by the household's children.

18 Claims, 5 Drawing Sheets

(56) References Cited

U.S. PATENT DOCUMENTS

| | | | | |
|---|---|---|---|---|
| 6,767,296 | B1 * | 7/2004 | Johnson | A63B 69/0013 473/499 |
| 7,186,183 | B2 * | 3/2007 | Zeilinger | A63G 9/02 248/370 |
| 7,975,437 | B2 * | 7/2011 | Byrd | A63H 33/008 446/110 |
| 8,172,693 | B1 | 5/2012 | Guerzini et al. | |
| 8,186,109 | B2 * | 5/2012 | Warminsky | E04H 9/10 52/745.02 |
| 8,777,767 | B2 * | 7/2014 | Kopp | A63G 9/00 472/136 |
| 9,192,867 | B1 * | 11/2015 | Sann | A63B 17/02 |
| 9,277,745 | B2 * | 3/2016 | Harris | A01M 31/025 |
| 9,278,291 | B2 * | 3/2016 | Scherba | A63G 9/00 |
| 2007/0078014 | A1 | 4/2007 | Nye et al. | |
| 2016/0192616 | A1 | 7/2016 | Kitchen | |

* cited by examiner

SHED AND MODULAR PLAYSET ACCESSORY SYSTEM

FIELD OF THE INVENTION

The present teachings relate to the combination of a storage shed and a playset for use in the yard of a homeowner.

BACKGROUND OF THE INVENTION

While the average floor area of a typical single-family home has increased, the average lot size for these homes has decreased. This has left many homeowners with a relatively small yard space. As a result, these families have had to sacrifice having an outdoor playset for their children in order to have enough room for a more practical storage shed. In other scenarios, families with small yards that have installed both a storage shed and a playset are left with little or no additional room for other yard accessories or activities.

Moreover, even if there is enough space in the homeowner's yard for both a storage shed and a playset, the playset is quickly outgrown by the children of the household. When the playset is outgrown, it oftentimes remains in the yard and subject to the elements which slowly degrade the playset resulting in an in unpleasant eyesore and the depreciation of the homeowner's property value.

Accordingly, there exists a need for an outdoor structure that can provide storage for a typical homeowner while also conserving yard space for modular playset accessories that can be periodically interchanged, upgraded, and later discarded when outgrown by the household's children thereby leaving only a storage shed.

SUMMARY OF THE INVENTION

The present teachings provide a shed and modular playset accessory system. The system can include a storage shed including a roof, a removeable platform capable of being operatively arranged with the storage shed above the roof, and a plurality of playset accessories each configured to be releasably securable to the removeable platform.

The present teachings provide another embodiment of a shed and modular playset accessory system. The system can include a storage shed including a roof and a removeable platform mountable above the storage shed. The removeable platform can include a floor with a safety fencing configured about the floor. The system includes a climbing mechanism capable of being arranged with the storage shed and configured to provide access to the floor of the removable platform. At least one playset accessory is configured to be releasably securable to the removeable platform using a fastening mechanism arranged on the platform.

The present teachings still further provide a shed and playset accessory kit. The kit can include a storage shed including a roof, a removeable platform assembly configured to be releasably securable to the storage shed, and a plurality of playset accessories each configured to be releasably securable to the removeable platform using a fastening mechanism arranged on the platform.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

Figure 1:
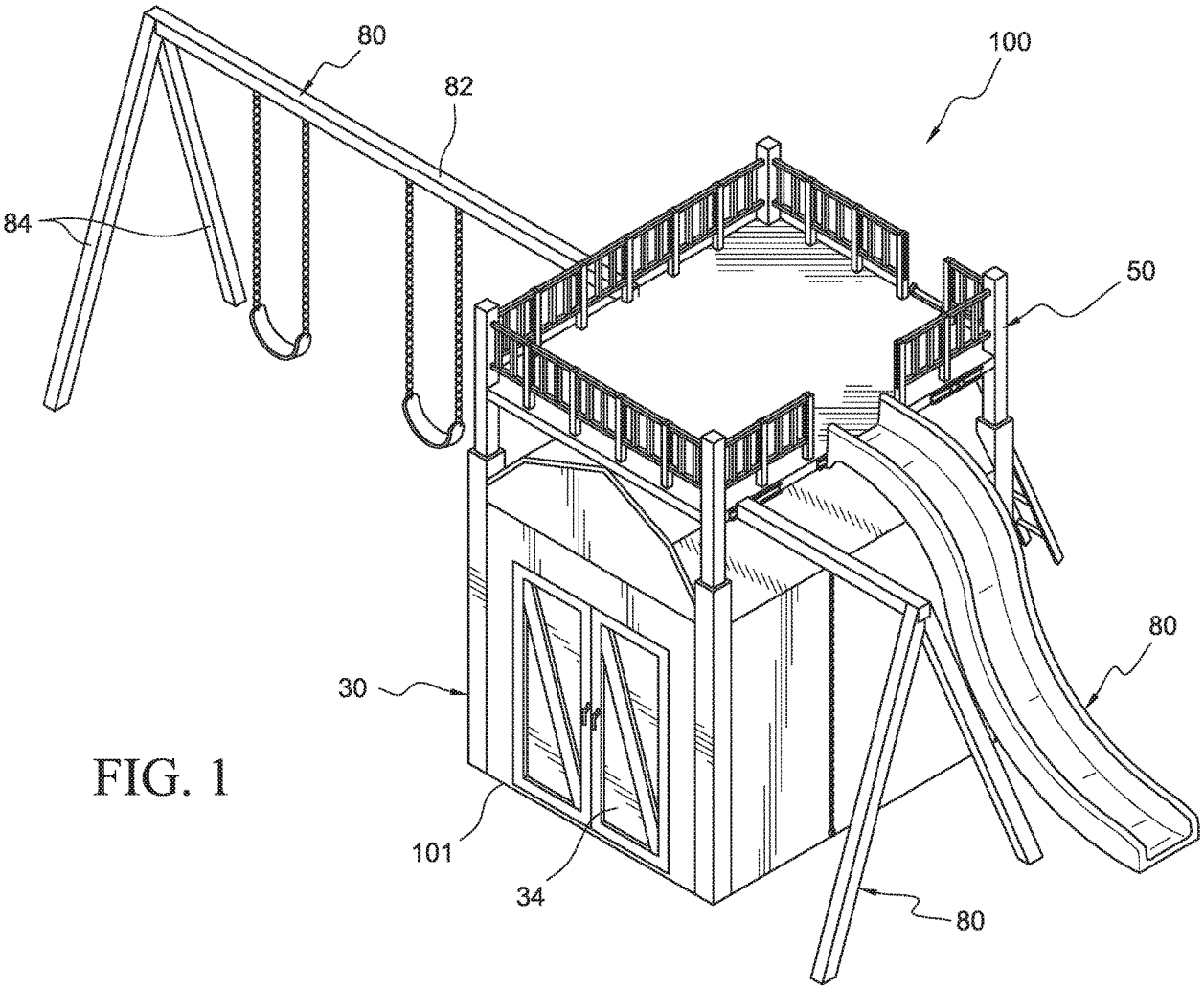
FIG. 1 shows a perspective view of the shed and modular playset accessory system of the present teachings.

Referring initially to FIG. 1, a shed and modular playset accessory system 100 in accordance with a preferred embodiment of the present teachings is shown. The shed and playset system 100 can include a storage shed component 30, a platform component 50 including a safety fencing, and a plurality of modular playset accessories 80. As will be discussed in more detail below, the plurality of modular playset accessories 80 can be interchangeably mounted and secured to the storage shed 30 or to the platform 50 arranged on top of the storage shed 30. While one or more modular playset accessories 80 can be secured to the storage shed 30 and/or the platform 50 at any one time, access to the internal portion of the storage shed 30 can remain available for storage purposes. The shed and playset system 100 provides the homeowner with the combination of a storage shed and a customizable playset while minimizing the utilization of critical yard space.

As the needs of the children using the playset change, the shed and playset system 100 of the present teachings allows new playset accessories 80 to be added, substituted, or removed. As a result, the shed and playset system 100 allows the playset accessory arrangement to change and grow as the homeowner's children grow. Later, when the children have outgrown the need for the playset, all of the playset accessories 80 can be removed and the homeowner can be left with the storage shed 30 and the platform 50. The homeowner can then optionally leave the platform 50 on top of the storage shed 30 for use as a sun deck or can also remove the platform 50 leaving only the storage shed 30.

Figure 2:
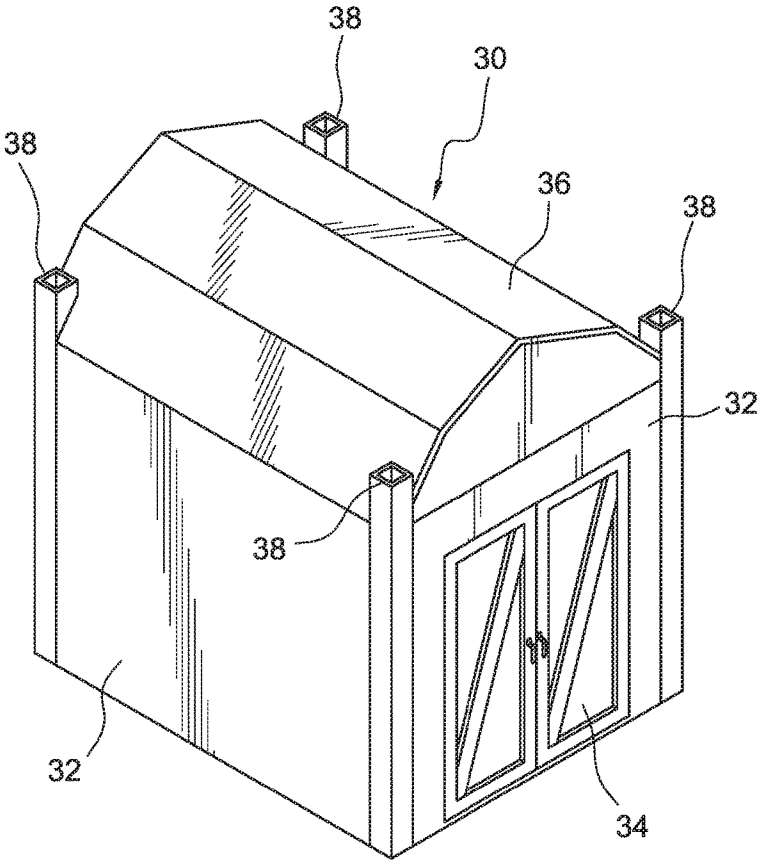
FIG. 2 shows a perspective view of the shed component of the system of FIG. 1.

The storage shed 30 can include features of commonly known storage sheds. For example, as best shown in FIG. 2, the storage shed 30 can include four exterior walls 32 and at least one entryway 34 such as a door formed in one of the exterior walls 32 for entry into the interior of the storage shed 30. The storage shed 30 can be square, rectangular, or any other shape. The height of the storage shed walls 32 can be from about 6 feet to about 8 feet. The storage shed 30 can also optionally include one or more windows formed in one or more of the exterior walls 32. The roof 36 of the storage shed 30 can be any style, such as a gambrel roof shown in FIG. 2. Other designs for the roof 36 can include a gable roof, a flat roof, a saltbox roof, a hip roof, a slanted roof, a mansard roof, an M roof, and the like.

The storage shed 30 of the present teachings is built having a strength capable of supporting the platform 50 along with a variable dynamic load that would be applied to the storage shed 30 by children and/or adults standing, crawling, jumping, or generally moving on the platform 50. To achieve such a strength, the storage shed 30 can include any additional reinforced framing, a floor, a ceiling structure, and the like. The storage shed 30 can be made from various materials, with wooden and plastic being the most common materials. For example, main types of construction of the storage shed 30 could be metal sheathing over a metal frame, plastic sheathing and frame, all-wood construction, and vinyl-sided built over a wooden frame. The roof 36 of the storage shed 30 can also be made of various materials, such as, for example, asphalt shingled or sheathed in tin.

Figure 3:
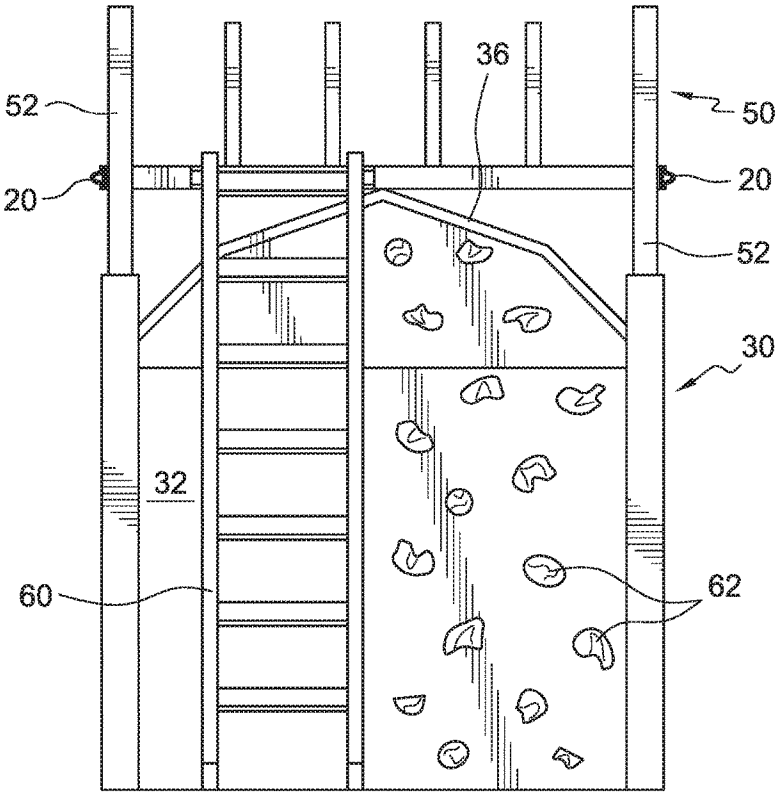
FIG. 3 shows a rear view of the shed and platform assembly of the system of the present teachings.

Referring to FIG. 3, a ladder 60 can be arranged at one or more of the exterior walls 32 of the storage shed 30. The ladder 60 can be permanently attached to the storage shed 30 such that it remains secured to the storage shed 30 when the platform 50 and/or play accessories 80 are removed. Alternatively, the ladder 60 can be releasably attached to any side of the platform 50 or to an exterior wall 32 of the storage shed 30. The ladder 60 can allow access to the platform 50 when the platform 50 is attached to the storage shed 30. Optional rock climbing grips 62 can also be permanently or removably attached to at least one or more of the exterior walls 32 of the storage shed 30 to allow access to the platform 50.

As shown in FIGS. 1-5, the platform 50 can be releasably secured to the top of the storage shed 30, such as above the roof 36 thereof. For example, the platform 50 can include one or more platform support posts 52 that can extend into and attach to the storage shed using insertion brackets 38 mounted with the storage shed 30. The number of platform support posts 52 can vary depending on the shape of the roof 36. For example, a roof 36 with a gambrel or gable roof could require a platform 50 having at least four platform support posts 52 (along with at least four corresponding insertion brackets 38 mounted with the storage shed 30), whereas a slanted roof 36 could require a platform 50 having two platform support posts 52 (and two corresponding insertion brackets 38) with the remaining two corners of the platform 50 being arranged to rest on an upper portion of the slanted roof 36.

Figure 5:
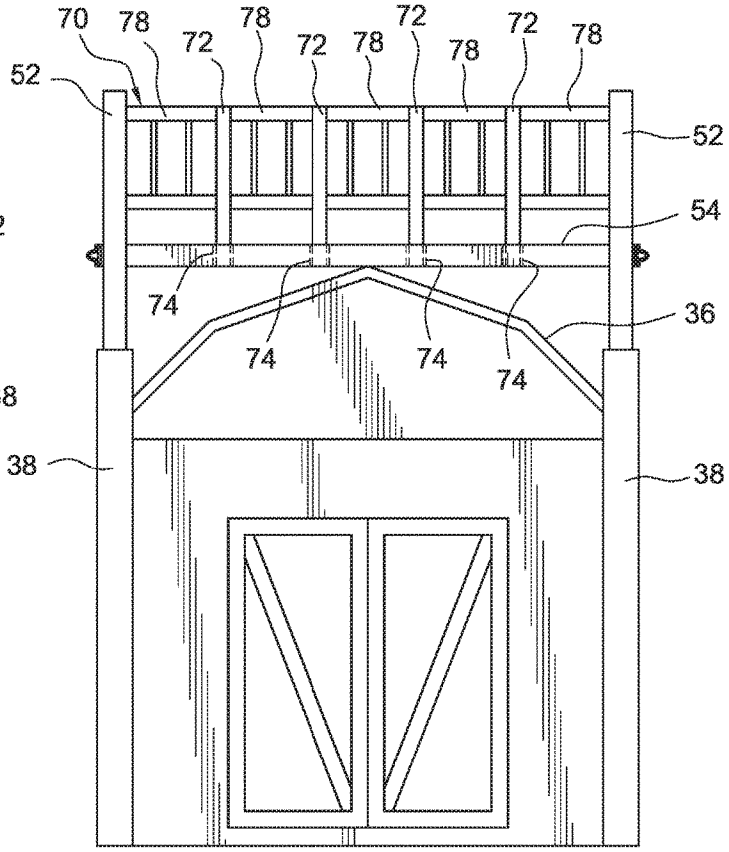
FIG. 5 shows a front view of the shed and platform assembly of FIG. 3.
Figure 4:
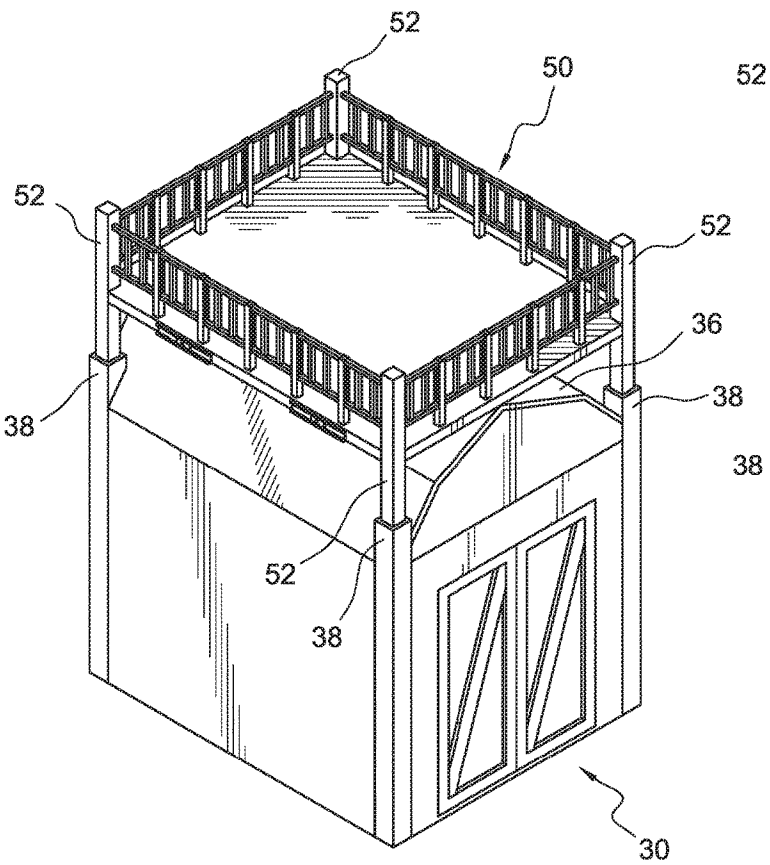
FIG. 4 shows a perspective view of the shed and platform assembly of FIG. 3.
Figure 6:
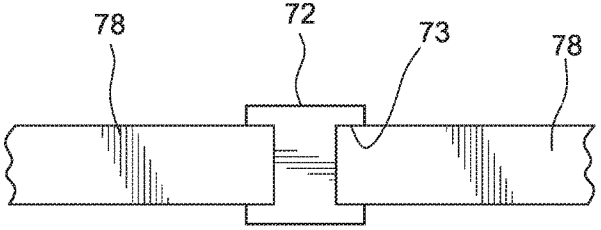
FIG. 6 shows a top view of two fencing sections secured to a fencing post of the platform component of the present teachings.

As best shown in FIG. 5, the platform 50 can include a floor 54 including safety fencing 70 at least partially surrounding the perimeter of the floor 54. The safety fencing 70 can include a plurality of safety fencing posts 72 which can be inserted into safety fencing brackets 74 arranged about the floor 54. A plurality of fence sections 78 can be removably secured between the safety fencing posts 72. Referring to FIG. 6, fencing sections 78 can be inserted into a groove 73 formed in a face of a fencing post 72 so that each fence section 78 can be readily slid into place between neighboring fencing posts 72. As such, each fencing post 72 can include grooves 73 on opposing side surfaces thereof. A locking mechanism (not shown) can be arranged between each fencing post 72 and a corresponding fence section 78 to retain the fence section 78 in place during use of the platform 50.

When a modular playset accessory 80 is secured to the platform 50 as will be discussed in more detail below, the fence section 78 above that playset accessory 80 can be unlocked and removed to allow access from the floor 54 of the platform 50 to the playset accessory 80. When that playset accessory 80 is later detached from the platform 50, the removed fence section 78 can be reinserted to the platform 50 and locked in place to the fencing post 72.

The modular playset accessories 80 can include, but are not limited to, a slide, a rockwall (with or without a rope), a firepole, a rope ladder, a monkey bars, and the like. As shown in FIG. 1, the playset accessory 80 can be a tri-post arrangement including a top rail 82 and a set of support legs 84 to which a plurality of accessories can be attached thereto. Such accessories can include a swing, rings, a tire, a trapeze bar with rings, a tandem swing, a nest swing, a bench swing, a firepole, and the like.

Figure 7A:
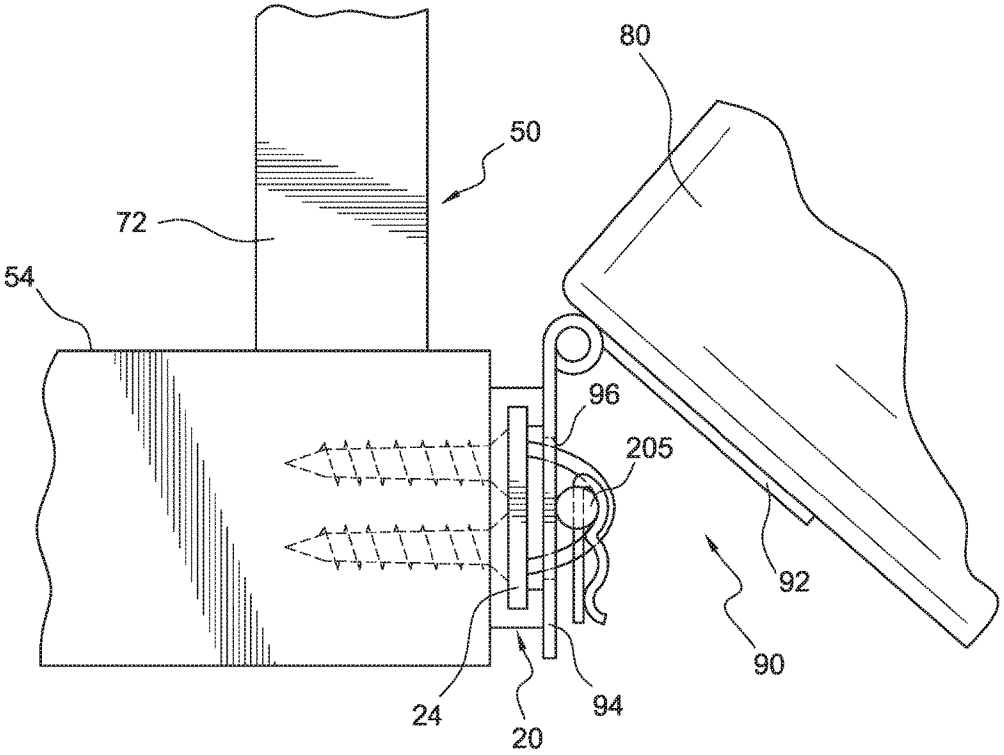
FIG. 7A shows a hasp latch connected to the track system releasably securing a playset accessory to the platform component of the present teachings.
Figures 7B, 8A, 8B:
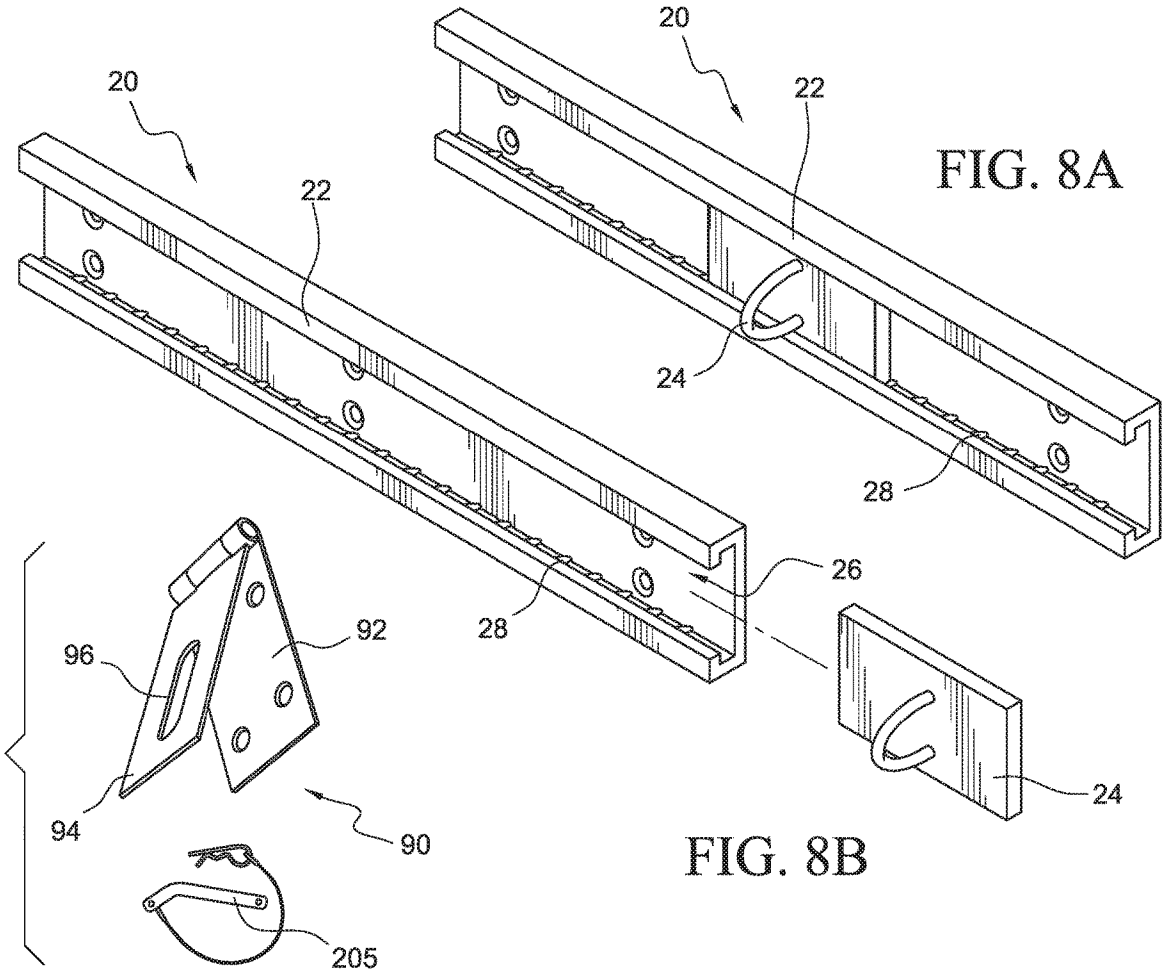
FIG. 7B shows the hasp latch of FIG. 7A.
FIGS. 8A and 8B show a track system of the present teachings.

Each modular playset accessory 80 can attach to the platform 50 using a removable fastener 90, such as, for example, a hasp latch, a hinge, a generic latch, and the like. FIGS. 7A and 7B show a fastener that is a hasp latch 90 that includes a first plate 92 that is hinged to a second plate 94 having a slot 96. When the hasp latch 90 is used to attach a playset accessory 80 to the platform 50, the first plate 92 of the hasp latch can be attached to the top of the play accessory 80 by way of screws or any other fasteners. The second plate 94 of the hasp latch 90 can secure to a track system 20 secured to the platform 50. For example, the second plate 94 can secure to the track system 20 via a structural portion of the track system 20 that extends through the slot 96 and locks as will be discussed in more detail below.

The track system 20 can be arranged on one or more sides of the platform 50. The track system 20 allows the modular playset accessories 80 to releasably connect to the platform 50. The track system 20 can be arranged to extend at least partially along the width of the platform 50. Referring to FIGS. 8A and 8B, the track system 20 can include a track 22 and a u-connector 24 that can be selectively moved in the track 22 along the length thereof. The track 22 can define a C-shaped groove 26 within which the at least one u-connector 24 can be slideably arranged. Once a location for the u-connector 24 along the platform 50 is selected, the u-connector 24 can be held in position on the track 22 via notches 28 formed in the track 22.

As best shown in FIG. 7A, the slot 96 in the hasp latch 90 of the playset accessory 80 can be pivoted downwardly so the u-connector 24 can extend through the slot 96 and a lock pin 98 can be inserted through the u-connector 24 to secure the hasp latch 90 to the u-connector 24. The lock pin 98 can include a clip 99 to lock the pin 98 in place, as shown in FIG. 7B. To remove the playset accessory 80 from the platform 50, the lock pin 98 can be removed and the hasp latch 90 pivoted away from the u-connector 24. The releasable connection mechanism allows the various playset accessories 80 to be interchanged, removed, and upgraded as children grow and their playset needs change. While the hasp latch 90 and the track system 20 can be used to connect the playset accessories 80 to the platform 50, any other modular connection mechanism can be used with the shed and playset system 100 of the present teachings.

When the playset accessories 80 are no longer needed, the playset accessories 80 can be removed and the storage shed 30 can remain with the platform 50 or the platform 50 can also be removed. This frees up yard space for other uses, prevents the playset from degrading and becoming an eyesore, and prevents the depreciation of the homeowner's property value.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A shed and modular playset accessory system comprising:

a storage shed including a roof;

a removeable platform capable of being selectively connected with the storage shed directly above the roof of the storage shed; and a plurality of playset accessories each configured to be releasably securable to the removeable platform.

2. The shed and modular playset accessory system of claim 1, wherein at least one of the plurality of playset accessories is releasably securable to the removeable platform via a fastener and track system.

3. The shed and modular playset accessory system of claim 1, wherein the platform includes a plurality of safety fencing sections configured to be releasably mountable to the platform.

4. The shed and modular playset accessory system of claim 3, wherein at least one of the safety fencing sections is capable of being removed from the removable platform when a pre-determined playset accessory is secured to the removable platform to allow access to the playset accessory from the platform.

5. The shed and modular playset accessory system of claim 4, wherein the predetermined playset accessory is a slide.

6. The storage shed of claim 1, wherein one of the plurality of playset accessories includes a tri-post arrangement onto which at least one play accessory is mountable.

7. A shed and modular playset accessory system including:

a storage shed including a roof;

a removeable platform mountable directly above the roof of the storage shed and configured to be selectively connected with the storage shed, the removeable platform including a floor with a safety fencing configured about the floor;

a climbing mechanism capable of being arranged with the storage shed and configured to provide access to the floor of the removable platform; and at least one playset accessory configured to be releasably securable to the removeable platform using a fastening mechanism arranged on the platform.

8. The shed and modular playset accessory system of claim 7, wherein the at least one playset accessory includes a plurality of playset accessories each configured to be releasably securable to the removeable platform using a fastening mechanism arranged on the platform.

9. The shed and modular playset accessory system of claim 7, wherein the safety fencing includes a plurality of safety fencing sections being releasably mountable to the platform.

10. The shed and modular playset accessory system of claim 9, wherein at least one of the safety fencing sections can be removed from the removable platform when a pre-determined playset accessory is secured to the removable platform to allow access to the playset accessory from the platform.

11. The shed and modular playset accessory system of claim 10, wherein the predetermined playset accessory is a slide.

12. The modular storage shed and play accessory system of claim 7, wherein the at least one playset accessory includes a tri-post arrangement onto which additional play accessories can be mounted.

13. A shed and playset accessory kit comprising:

a storage shed including a roof;

a removeable platform assembly configured to be selectively connected to the storage shed directly above the roof of the storage shed; and a plurality of playset accessories each configured to be releasably securable to the removeable platform using a fastening mechanism arranged on the platform.

14. The shed and playset accessory kit of claim 13, wherein the fastening mechanism is a fastener and track system.

15. The shed and playset accessory kit of claim 13, wherein the removable platform includes a floor with a safety fencing configured about the floor.

16. The shed and playset accessory kit of claim 15, wherein the safety fencing includes a plurality of safety fencing sections being releasably mountable to the platform.

17. The shed and playset accessory kit of claim 16, wherein at least one of the safety fencing sections can be removed from the removable platform when a pre-determined playset accessory is secured to the removable platform to allow access to the playset accessory from the platform.

18. The shed and playset accessory kit of claim 17, wherein the predetermined playset accessory is a slide.

* * * * *